US012337212B2

(12) United States Patent
Zhou

(10) Patent No.: US 12,337,212 B2
(45) Date of Patent: Jun. 24, 2025

(54) FLOAT WITH RETRACTABLE FOOT REST

(71) Applicant: Zhejiang Mambobaby Baby Products Co., Ltd., Yiwu (CN)

(72) Inventor: Weixin Zhou, Jinhua (CN)

(73) Assignee: Zhejiang Mambobaby Baby Products Co., Ltd., Yiwu (CN)

( * ) Notice: Subject to any disclaimer, the term of this patent is extended or adjusted under 35 U.S.C. 154(b) by 540 days.

(21) Appl. No.: 17/878,178

(22) Filed: Aug. 1, 2022

(65) Prior Publication Data

US 2022/0370855 A1 Nov. 24, 2022

(30) Foreign Application Priority Data

Jun. 6, 2022 (CN) ..... 202221412437.2

(51) Int. Cl.

| | |
|---|---|
| ***A63B 31/00*** | (2006.01) |
| ***A47C 7/50*** | (2006.01) |
| ***A47C 15/00*** | (2006.01) |
| ***B63B 34/50*** | (2020.01) |

(52) U.S. Cl.

CPC ..... *A63B 31/00* (2013.01); *A47C 7/506* (2013.01); *A47C 15/006* (2013.01); *B63B 34/50* (2020.02); *A63B 2208/12* (2013.01); *A63B 2225/09* (2013.01); *A63B 2225/605* (2013.01)

(58) Field of Classification Search

CPC . A63B 31/00; A63B 2208/12; A63B 2225/09; A63B 2225/605; B63B 34/50

See application file for complete search history.

(56) References Cited

U.S. PATENT DOCUMENTS

2010/0037510 A1* 2/2010 Nahoom ..... A01K 93/00 43/43.14
2012/0015571 A1* 1/2012 Warmuth-Rued ..... A63B 69/12 441/129
2019/0282858 A1* 9/2019 Harkins ..... B63C 9/115

FOREIGN PATENT DOCUMENTS

WO WO-2016114547 A1 * 7/2016 ..... A63B 31/00

* cited by examiner

*Primary Examiner* — S. Joseph Morano
*Assistant Examiner* — Jovon E Hayes
(74) *Attorney, Agent, or Firm* — Birchwood IP

(57) ABSTRACT

The present invention proposes a float with a retractable foot rest, comprising a lying float body, a supporting element, a protecting assembly and a foot rest cushion. The supporting element and the protecting assembly are installed in a lying float splicing body; the foot rest cushion that can be retracted or expanded is installed at the lower end of the supporting element; and the foot rest cushion is connected with the supporting element. When the float is worn, the foot rest cushion can be expanded to replace an additional bath towel that needs to be placed on the ground to prevent dirt. After wearing, the foot rest cushion can be retracted below the supporting element, or as required, the floating body is spliced on the lying float body, and the foot rest cushion is connected with the floating body.

9 Claims, 3 Drawing Sheets

FLOAT WITH RETRACTABLE FOOT REST

TECHNICAL FIELD

The present invention relates to the technical field of floats, and particularly relates to a float with a retractable foot rest.

BACKGROUND

Swimming can effectively promote the development of the brain and nervous system of infants, stimulate the potential of infants, lay a good foundation for improving EQ and IQ of children, and can also enhance myocardial function, enhance resistance and strengthen lung function. For infants, swimming lying floats are indispensable swimming aids, and can adapt to the needs of use in water for infants over 3 months old.

The supporting cushion of the existing lying float is short, and can only support the chest; and the legs and feet of the infants cannot be placed on the supporting cushion. Therefore, when the lying float is worn for the infants, a bath towel must be placed in the ground to support the legs of the infants to ensure cleanliness and sanitation.

SUMMARY

The purpose of the present invention is to solve the problems in the prior art to propose a float with a retractable foot rest, which can support the legs and feet of the infants when the float is worn for the infants to ensure sanitation.

To achieve the above purpose, the present invention proposes a float with a retractable foot rest, comprising a lying float body, a supporting element, a protecting assembly and a foot rest cushion. The supporting element and the protecting assembly are installed in a lying float splicing body; the foot rest cushion that can be retracted or expanded is installed at the lower end of the supporting element; and the foot rest cushion is connected with the supporting element.

Preferably, strap assemblies or a storage bag for retracting the foot rest cushion is arranged below the supporting element.

Preferably, each strap assembly comprises a bundling belt and a locking element; the locking element is installed on the supporting element; one end of the bundling belt is fixed below the supporting element, and the other end is detachably connected with the locking element; and the locking element is a buckle, a button, a velcro or a fixing belt.

Preferably, water permeable holes are uniformly distributed on the foot rest cushion.

Preferably, the foot rest cushion is connected with the supporting element through a first connector, and the first connector is a zipper or a velcro or a fastener structure.

Preferably, the float with the retractable foot rest further comprises a floating body; the floating body is detachably installed at an open end of the lying float body through a second connector; and the second connector is a zipper or a velcro or a fastener structure.

Preferably, the foot rest cushion is detachably connected with the floating body through a third connector, and the third connector is a zipper or a velcro or a fastener structure.

Preferably, the protecting assembly is provided with an adjustable chest protecting part; the chest protecting part is installed on the supporting element; and the supporting element is installed on an inner ring of the lying float splicing body.

Preferably, the protecting assembly further comprises two shoulder straps installed on the supporting element.

Preferably, the protecting assembly further comprises a crotch protecting part.

The present invention has the following beneficial effects: in the present invention, through the cooperation of the lying float body, the supporting element, the protecting assembly, the foot rest cushion, the first connector and the floating body, when the float is worn, the foot rest cushion can be expanded to replace an additional bath towel that needs to be placed on the ground to prevent dirt. After wearing, the foot rest cushion can be retracted below the supporting element, or as required, the floating body is spliced on the lying float body, and the foot rest cushion is connected with the floating body, to support the legs and feet of a user to realize the function of a floating bed.

The features and advantages of the present invention will be described in detail through embodiments and in combination with the drawings.

DETAILED DESCRIPTION

Figure 1:
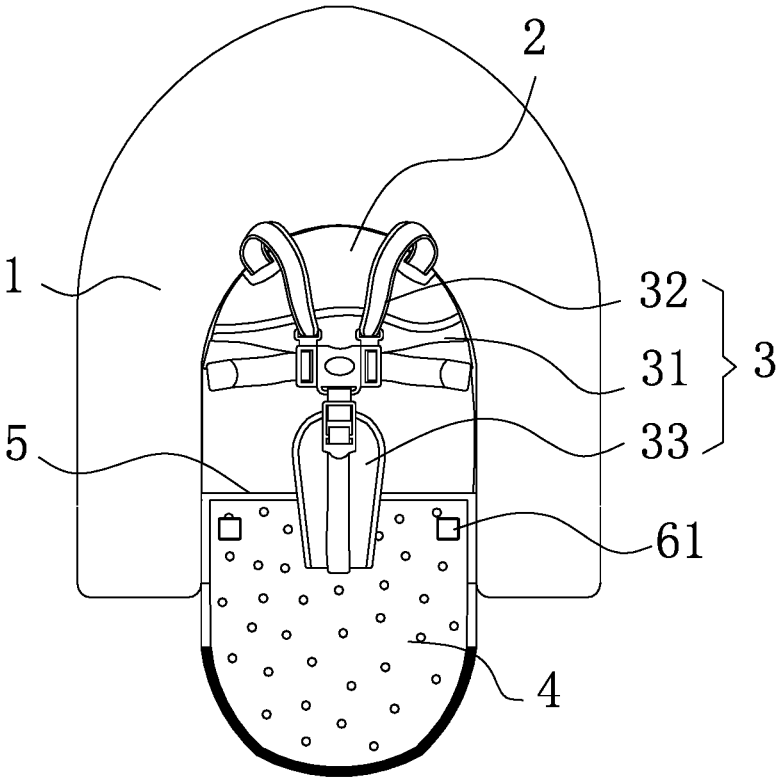
FIG. 1 is a structural schematic diagram of a foot rest cushion of embodiment 1 of a float with a retractable foot rest in an expanded state in the present invention.
Figure 2:
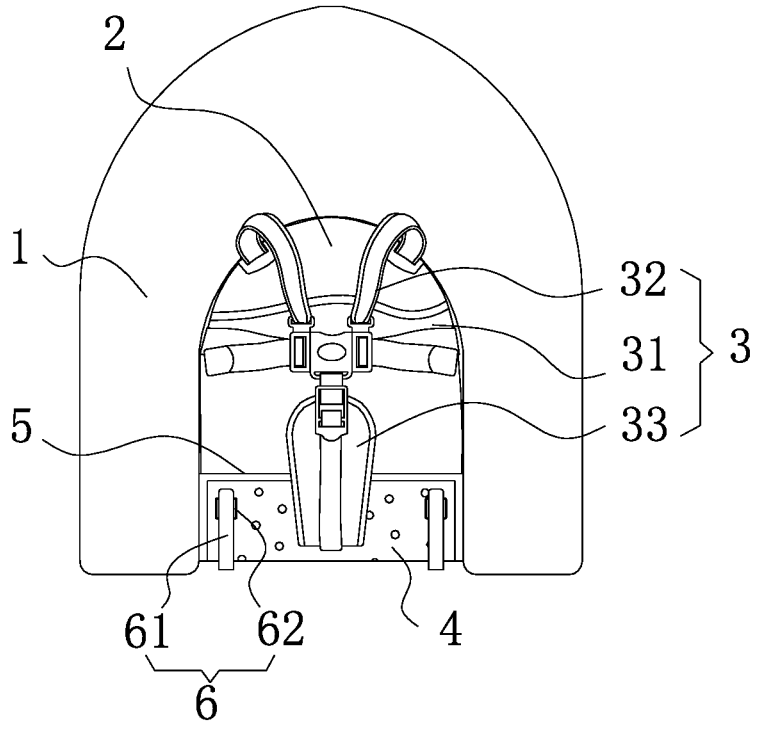
FIG. 2 is a structural schematic diagram of a foot rest cushion of embodiment 1 of a float with a retractable foot rest in a retracted state in the present invention.

By referring to FIG. 1 to FIG. 2, a float with a retractable foot rest in the present invention comprises a lying float body 1, a supporting element 2, a protecting assembly 3 and a foot rest cushion 4. The supporting element 2 and the protecting assembly 3 are installed in a lying float splicing body 1; the foot rest cushion 4 that can be retracted or expanded is installed at the lower end of the supporting element 2; and the foot rest cushion 4 is connected with the supporting element 2 through a first connector 5, or is of an integral structure with the supporting element 2. The first connector 5 is a zipper or a velcro or a fastener structure. Water permeable holes are uniformly distributed on the foot rest cushion 4 so that water can penetrate into an upper surface to enable the body of the user to come into contact with the water. When wearing, the foot rest cushion 4 can be expanded to present a state shown in FIG. 1, to replace an additional bath towel that needs to be placed on the ground to prevent dirt. After wearing, the foot rest cushion can be retracted below the supporting element to present a state shown in FIG. 2.

Further, in the present embodiment, as shown in FIG. 2, the foot rest cushion 4 is retracted below the supporting element 2 through a plurality of strap assemblies 6. Specifically, each strap assembly 6 comprises a bundling belt 61 and a locking element 62; the locking element 62 is installed on the supporting element 2; one end of the bundling belt 61 is fixed below the supporting element 2, and the other end is detachably connected with the locking element 62; and the locking element 62 is a buckle, a button, a velcro or a fixing belt.

Of course, the foot rest cushion 4 can be retracted in other modes. For example, a storage bag for retracting the foot rest cushion 4 is arranged below the supporting element 2, and the foot rest cushion 4 is folded or rolled up and then placed in the storage bag to realize storage.

Further, in the present embodiment, the protecting assembly 3 is provided with an adjustable chest protecting part 31; the chest protecting part 31 is installed on the supporting element 2; and the supporting element 2 is installed on an inner ring of the lying float splicing body 1. Further, the protecting assembly 3 further comprises two shoulder straps 32 installed on the supporting element 2, and a crotch protecting part 33. A user can be bound within a certain range through the chest protecting part 31, the adjustable shoulder straps 32 and the crotch protecting part 33, to reduce the movement range of the user on the water and avoid the problem of easy rollover. Moreover, the tightness of the bondage can be adjusted as required, to improve comfort.

Embodiment 2

Figure 3:
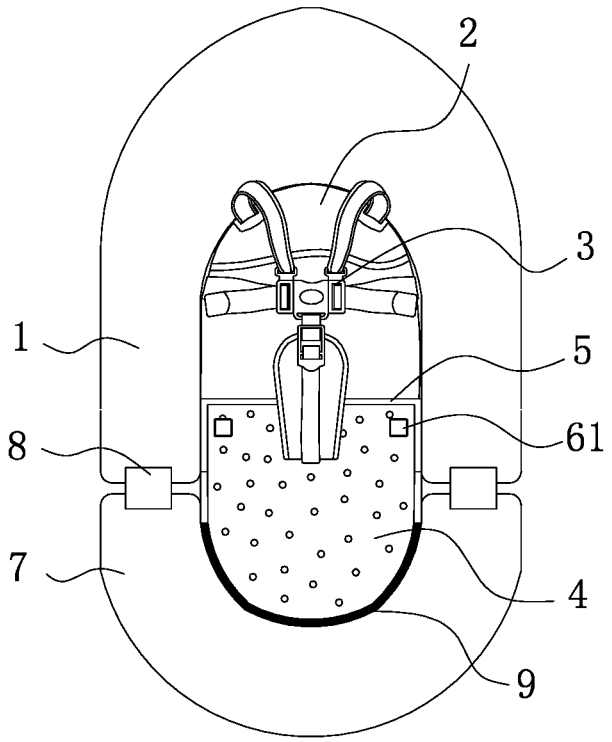
FIG. 3 is a structural schematic diagram of embodiment 2 of a float with a retractable foot rest as a floating bed in a use state in the present invention.

By referring to FIG. 3, the float with the retractable foot rest further comprises a floating body 7; the floating body 7 is detachably installed at an open end of the lying float body 1 through a second connector 8; and the second connector 8 is a zipper or a velcro or a fastener structure.

Further, the foot rest cushion 4 is detachably connected with the floating body 7 through a third connector 9, and the third connector 9 is a zipper or a velcro or a fastener structure.

Further, the lying float body 1 is a U-shaped structure or an H-shaped structure; the lying float body 1 and the floating body 7 are foam material or air bags; and the float can be compressed by compressing the foam material (sponge)/air bags and exhausting air, to reduce the volume of the float, which is convenient for the placement and carrying of the float.

In use, the floating body 7 is spliced on the lying float body 1, and the foot rest cushion 4 is connected with the inner ring of the floating body 7; and the foot rest cushion 4 can support the legs and feet of the user to realize the function of a floating bed.

The above embodiments are explanations of the present invention, not limitations to the present invention. Any solution after simple transformation of the present invention shall belong to the protection scope of the present invention.

What is claimed is:

1. A float with a retractable foot rest, comprising a lying float body, a supporting element, a protecting assembly and a foot rest cushion, wherein the supporting element and the protecting assembly are installed in the lying float body; the foot rest cushion that can be retracted or expanded is installed at a lower end of the supporting element; and the foot rest cushion is connected with the supporting element;

wherein water permeable holes are uniformly distributed on the foot rest cushion.

2. The float with the retractable foot rest according to claim 1, wherein strap assemblies or a storage bag for retracting the foot rest cushion is arranged below the supporting element.

3. The float with the retractable foot rest according to claim 2, wherein each strap assembly comprises a bundling belt and a locking element;

the locking element is installed on the supporting element;

one end of the bundling belt is fixed below the supporting element, and the other end of the bundling belt is detachably connected with the locking element; and the locking element is a buckle, a button, a velcro or a fixing belt.

4. The float with the retractable foot rest according to claim 1, wherein the foot rest cushion is connected with the supporting element through a first connector, and the first connector is a zipper or a velcro or a fastener structure.

5. The float with the retractable foot rest according to claim 1, further comprising a floating body, wherein the floating body is detachably installed at an open end of the lying float body through a second connector; and the second connector is a zipper or a velcro or a fastener structure.

6. The float with the retractable foot rest according to claim 5, wherein the foot rest cushion is detachably connected with the floating body through a third connector, and the third connector is a zipper or a velcro or a fastener structure.

7. The float with the retractable foot rest according to claim 1, wherein the protecting assembly is provided with an adjustable chest protecting part; the chest protecting part is installed on the supporting element; and the supporting element is installed on an inner ring of the lying float body.

8. The float with the retractable foot rest according to claim 7, wherein the protecting assembly further comprises two shoulder straps installed on the supporting element.

9. The float with the retractable foot rest according to claim 7, wherein the protecting assembly further comprises a crotch protecting part.

* * * * *